US012758826B2

(12) United States Patent
Leavitt

(10) Patent No.: US 12,758,826 B2
(45) Date of Patent: Oct. 13, 2026

(54) SYSTEMS AND METHODS FOR MONITORING AND CONTROLLING A HYDRAULIC TREADMILL APPARATUS BY MEDICAL PERSONNEL

(71) Applicant: Douglas F. Leavitt, Bethlehem, PA (US)

(72) Inventor: Douglas F. Leavitt, Bethlehem, PA (US)

( * ) Notice: Subject to any disclaimer, the term of this patent is extended or adjusted under 35 U.S.C. 154(b) by 161 days.

(21) Appl. No.: 18/894,174

(22) Filed: Sep. 24, 2024

(65) Prior Publication Data

US 2025/0010139 A1 Jan. 9, 2025

Related U.S. Application Data

(63) Continuation-in-part of application No. 18/143,796, filed on May 5, 2023, now Pat. No. 12,194,337.

(51) Int. Cl.
*A63B 24/00* (2006.01)
*A63B 22/02* (2006.01)

(52) U.S. Cl.
CPC ..... *A63B 24/0087* (2013.01); *A63B 22/0264* (2015.10); *A63B 2225/60* (2013.01)

(58) Field of Classification Search
CPC ..... A63B 22/0264; A63B 21/0083; A63B 2220/36; A63B 2220/833; A63B 2225/50; A63B 2225/60
See application file for complete search history.

(56) References Cited

U.S. PATENT DOCUMENTS 4,576,376 A * 3/1986 Miller ..... A63B 22/02 482/111
4,712,788 A * 12/1987 Gaudreau, Jr. ..... A63B 22/02 4/496
4,776,581 A * 10/1988 Shepherdson ..... A63B 22/02 D24/188
4,918,766 A * 4/1990 Leonaggeo, Jr. ..... A63B 22/02 482/4
5,102,380 A * 4/1992 Jacobson ..... A63B 22/02 482/111
5,111,127 A * 5/1992 Johnson ..... H01M 50/296 320/101

(Continued)

*Primary Examiner* — Andrew S Lo
(74) *Attorney, Agent, or Firm* — James R. McDaniel

(57) ABSTRACT

A treadmill system for aquatic therapy, including: a control unit having programmed logic computer (PLC) and a HMI (HMI-1) located at the power unit on the pool deck, designed for physical therapists having a set of controls and override capabilities; a mechanism allowing the physical therapist to set and adjust the maximum speed of the treadmill through the HMI-1, which ensures the treadmill speed remains within safe limits; a control unit with a database storing patient-specific settings; an interface allowing input of a patient's name or code to retrieve previously stored settings; a feature enabling control of the speed settings based on the retrieved data, wherein the system personalizes treatment for each patient and enhances the consistency of therapy sessions; a 12-volt patient control pad located on the treadmill; and a display driven by a HDMI-2 is dedicated to displaying patient-specific data and feedback and providing entertainment for the patient.

17 Claims, 14 Drawing Sheets

(56) References Cited

U.S. PATENT DOCUMENTS

| | | | | |
|---|---|---|---|---|
| 5,123,641 | A * | 6/1992 | Abboudi | A63B 21/00069 416/54 |
| 5,476,430 | A * | 12/1995 | Lee | A63B 22/02 482/3 |
| 5,558,604 | A * | 9/1996 | Hopkins | A63B 22/0264 482/111 |
| 5,921,892 | A * | 7/1999 | Easton | A63B 22/02 482/54 |
| 7,981,000 | B2 | 7/2011 | Watterson et al. | |
| 8,784,278 | B2 * | 7/2014 | Flake | A61H 33/6026 482/54 |
| 9,174,085 | B2 | 11/2015 | Foley et al. | |
| 11,472,030 | B2 | 10/2022 | Ho et al. | |
| 11,654,253 | B2 | 5/2023 | Homuth et al. | |
| 11,957,954 | B2 * | 4/2024 | Remsberg | A61B 5/1123 |
| 12,064,675 | B2 * | 8/2024 | Badita | A63B 69/125 |
| 2001/0051563 | A1 | 12/2001 | Turak et al. | |
| 2008/0271236 | A1 * | 11/2008 | Truman | A01K 15/027 4/541.1 |
| 2011/0294625 | A1 * | 12/2011 | Flake | A61H 33/0087 482/54 |
| 2016/0213976 | A1 * | 7/2016 | So | A63B 71/0622 |
| 2022/0305329 | A1 * | 9/2022 | McHugh | A63B 22/0235 |
| 2024/0366996 | A1 * | 11/2024 | Leavitt | A63B 22/0264 |

* cited by examiner

RPM to speed conversion

| | | | | |
|---|---|---|---|---|
| Dr Roller Dia | 66mm (2.6") | | Ratio | |
| Motor Sz | .79 Cu In/Rev | | 32 x 40 | |
| | Date | Hz | RPM - Roller (Belt Speed) | MPH |
| | 3/13/2024 | 5 | 60.2 | 0.51 |
| | | 10 | 121 | 0.95 |
| | | 20 | 237 | 1.87 |
| | | 30 | 354 | 2.8 |
| | | 40 | 470 | 3.74 |
| | | 50 | 593 | 4.63 |
| | | 60 | 580 | 5.23 |

SYSTEMS AND METHODS FOR MONITORING AND CONTROLLING A HYDRAULIC TREADMILL APPARATUS BY MEDICAL PERSONNEL

CROSS-REFERENCE TO RELATED APPLICATION

This application is a continuation-in-part of U.S. patent application Ser. No. 18/143,796, filed on May 5, 2023, the disclosure of which is hereby incorporated by reference in its entirety to provide continuity of disclosure to the extent such a disclosure is not inconsistent with the disclosure herein.

FIELD OF THE INVENTION

The present invention is generally related to hydraulic power units, specifically designed for integration with aquatic treadmills used in physical therapy and rehabilitation. The invention focuses on advanced monitoring, patient data access/storage and control systems to enhance the functionality, safety, and effectiveness of these treadmills in a pool environment. The key components of this invention include a programmable logic controller (PLC), programmable human-machine interfaces (HMIs) communicating with the PLC. A smaller HMI-1 at the power unit up on the pool deck for the physical therapist and a larger display to show speed, distance and time on treadmill for the patient in the pool, driven by a programmable headless HMI-2, located in the control box, a variable frequency drive (VFD) and a 12-volt control pad at the treadmill in the pool for the patient, all of which work together to provide speed control, remote monitoring patient override capabilities, and comprehensive patient data management for the physical therapist.

BACKGROUND OF THE INVENTION

Prior to the present invention, as set forth in general terms above and more specifically below, it is known that running is one of the most commonly used physical training exercises for people. It can enhance physique, exercise cardiopulmonary functions, does not need any instruments, and has no strict requirements on site. The underwater running is also an exercise mode, and due to the buoyancy of the water, the gravity borne by the body is reduced, and the compression of the joint is greatly reduced accordingly so that the damage of the running to each joint of the leg is effectively reduced. Underwater running is also a very suitable restorative exercise measure for joints or muscle injuries. Many professional athletes use a cross-training mode such as underwater running. Also, underwater running on the other hand, the resistance of the water greatly exceeds the resistance of the air, and the consumed heat is also greatly increased, which is very suitable for people who lose weight.

A hydrotherapy treadmill is a running or walking treadmill that is used in the water to provide mobility and exercise for a patient or participant allowing buoyancy to reduce the amount of stress to the participants' knees and ankles. The treadmill is driven by an electrically powered hydraulic pump housed up and out of the pool which rotates a motor via hydraulic input and output hydraulic hoses.

Hydrotherapy or aquatic therapy treadmills are used in therapy pools, swim spas, and offer low-impact, high-resistance low impact workouts for both humans and animals.

Further, also used in sports and healthcare. Large pools, freestanding units, and plunge pools are used in rehabilitation and exercise.

It is further known that a freestanding underwater treadmill allows versatility in that it can be removed for other functions being performed in those pools. Smaller therapy pools are becoming more popular in physical therapy, wellness and fitness centers. Hydrotherapy pools are smaller, are typically heated, and have become prevalent in physical therapy and exercise facilities which require multiple uses of these pools. There could be an Aqua aerobics class one day, a physical therapy session the next and the pool should be available for open use in general.

Freestanding underwater treadmills are placed in an existing pool. They are driven by an electrically powered hydraulic pump called a power pack, housed up and out of the pool which rotates a motor at the treadmill via input and output hydraulic hoses. This eliminates the risk of electric shock by separating the motor from the water.

Further, there are treadmills with their own tanks which can be filled and drained with each use and comprise most of the market. The price of such treadmills ranges between $80,000-$120,000 and higher depending on the complexity of the tank.

The freestanding treadmills require an existing pool. They are both powered by a hydraulic pump stationed in a utility room which is powered by 220-volt electric current. The treadmill motor is mounted to the frame of the treadmill and there is a tether comprising an output hydraulic hose from the pump and return line, the motor turns at a given torque and speed based on the flow rate and pressure of hydraulic fluid flowing through the motor. The electrically driven pump is out of the water to avoid proximately to the water for safety purposes.

A good runner using a hydrotherapy treadmill will exert little downward force on a treadmill whereas a heavier person walking or standing on a treadmill exerts a large downward force, requiring larger amounts of torque or higher flow rate/pressure of the hydraulic fluid.

A large person walking slowly on a treadmill creates downward loads of several hundred pounds which may range between 400-600 pounds. The increased resistance of water decreases the speed achieved on the treadmill with an advanced athlete being capable of running 5-8 MPH as an estimate. An average person will reach speeds of 1-3.0 MPH on the treadmill.

Current products advertise being capable of moving the surface of the belt at 5-7 MPH requiring a large amount of torque which is transferred through the rollers to drive the tread without sticking or stopping as the user's feet drive down on the surface of the belt.

With current hydrotherapy treadmills, large motors with direct drives to the treadmill roller require a high flow rate and pressure of hydraulic fluid running through the hydraulic motor. The power unit used for running such treadmills is a 220-volt power source which is subsequently placed in pump rooms where that power source is available.

220-volt electric lines are generally limited to pump rooms. Installing a 220-volt line is at least $2,000 and would not be considered to be available on a wall at the side of a pool. This is limiting in terms of where the treadmill can be placed as a tether to the power unit is also required. Moreover, 220 V wall outlets are not available in any pool environment.

Also, the current freestanding treadmills are large, heavy, and not easily movable in and out of the pool and not mobile.

Removing the existing treadmills from a pool requires several people or equipment to lift it out from the pool.

Furthermore, aquatic therapy has gained significant traction in physical therapy and rehabilitation due to its numerous benefits, such as reduced joint impact and enhanced resistance for strength training while reducing the stress of gravity on the patient's joints up to 80%. Treadmills designed for use in water, known as aquatic treadmills, play a crucial role in these therapeutic programs. However, integrating sophisticated control and monitoring systems into these treadmills has been challenging, particularly in a pool environment where water exposure and remote operation are critical considerations.

However, it is known that many existing aquatic treadmill systems do not incorporate advanced automation technologies, such as programmable logic controllers (PLCs) with human-machine interfaces (HMIs) and data management. This absence of automation restricts the ability of physical therapists to monitor and control the treadmill remotely. In a typical therapy pool, therapists must manage multiple patients simultaneously from the pool deck. Existing aquatic treadmill systems often lack advanced automation and remote monitoring capabilities.

It is also known that without robust safety mechanisms, patients using aquatic treadmills can inadvertently set the treadmill to unsafe speeds, thereby increasing the risk of injury. This is particularly concerning in aquatic environments, where the therapist may not be in immediate physical proximity to intervene quickly and where the physical therapist's attention may be divided while working with other patients in the pool. Safety is a paramount concern in any therapeutic environment, and aquatic treadmills pose unique risks.

It is further known that current systems often lack comprehensive data management capabilities, making it difficult to track and analyze patient progress over time. Effective data management is essential for personalizing therapy plans and providing accurate documentation for medical records and insurance purposes. Effective therapy requires detailed tracking and analysis of patient progress, but current aquatic treadmill systems fall short in data management. Current systems do not access and record detailed patient data, making it difficult to track progress over time and adjust therapy plans accordingly. Without comprehensive data, therapists cannot easily personalize therapy sessions based on individual patients' progress and needs. Accurate documentation is essential for medical records and proof of patient improvement insurance claims. The absence of integrated data management systems complicates this process, leading to inefficiencies and potential errors.

Therefore, it would be desirable to employ an aquatic hydraulic treadmill apparatus that helps patients recover from injuries or other mobility impairments by providing low-impact exercise options by providing precise control and monitoring capabilities that allow therapists to tailor sessions to the patient's specific needs and track progress over time.

It would also be desirable to employ an aquatic hydraulic treadmill apparatus that provides elderly patients benefit from the reduced joint stress provided by underwater exercise but also provides safety features and remote-control options that ensure that therapists can effectively manage multiple patients, thereby enhancing the overall therapy experience.

It would also be desirable to employ an aquatic hydraulic treadmill apparatus such that athletes can utilize aquatic treadmills for training and recovery, benefiting from controlled resistance and reduced impact on joints especially if the system is able to store and retrieve individual training data that allows for the customization of workout plans and monitoring of athletic performance.

It would also be desirable to provide a enhance user experience for patients and therapist by utilizing medical personnel and patient display human machine interfaces HMI-1, HMI-2 and the laptop communicate separately with the PLC to provide a clear and easily readable display of speed, time, and distance, improving accessibility for elderly patients and those with visual impairments and an ergonomic design that are designed for ergonomic use, thereby ensuring that they are easily accessible and comfortable for therapists to operate.

It would be desirable to have a large screen to use as entertainment as is typically used with treadmills to pass time while on the treadmill, displaying the speed, distance and time on treadmill as an overlay to the screen wen called up by the use or medical personnel.

It would be desirable to provide comprehensive data management that aims to improve data management capabilities, thereby facilitating personalized therapy and accurate documentation, improves patient data recording by recording detailed patient data, including speed, time, and distance, which can be used to track progress over time and adjust therapy plans accordingly, and improves integration with medical records by exporting the recorded data to standard hospital patient data software, such as EPIC, thereby ensuring accurate documentation for medical records and insurance claims.

It would be desirable to improve the durability and reliability in pool environments by recognizing the harsh conditions of both indoor and outdoor pool environments by aiming to ensure the durability and reliability of its components by providing a waterproof and UV-resistant control pad; and a robust construction that uses high-quality, durable materials for all components, minimizing maintenance requirements and enhancing overall reliability.

It would be desirable to improve water exposure by providing components such as the patient control pad attached to the treadmill, which is submerged must be resistant to chlorinated water exposure to prevent corrosion and malfunction. Conversely, the current pneumatic control systems are designed to be kept above water as they are not waterproof, Water entering the tubes can work its way back to the controls panel and create a potential shock hazard.

It would be desirable to provide equipment that is capable of being used outdoors and during long-term exposure to UV radiation. Outdoor pools expose equipment to UV radiation, which can degrade materials over time. Existing systems often lack UV-resistant components, thereby limiting them to indoor use or reducing their lifespan and reliability.

It would be desirable to provide equipment that is capable of being used in harsh conditions. The combination of water and chlorine creates a harsh environment for electronic and mechanical components. Durability and reliability in these conditions are critical but often lacking in traditional pneumatic control systems. comprised of bellows controls buttons that when pushed water entering the tubes is a danger as it can travel back up to the control panel and cause an electrical shock. The blockage caused by water in the tubes reduces the effectiveness of the air pulse as a control signal.

It would be desirable to improve the responsiveness in fine tuning of the treadmill's speed control. Traditional aquatic treadmills often rely on antiquated pneumatic system comprised of bellows controls buttons that when pushed send a pulse of air through tubes to the power unit that triggering mechanical relay switches in the control panel, thereby causing additional lag in controlling speed for the treadmill. The pneumatic signals are slower and less responsive or "spongey". Conversely, it would be desirable to provide a system that will improve responsiveness with speed adjustability being very sensitive in comparison with the known pneumatic systems. The 12-Volt electrical control pad will allow more responsive and subtle controls to that of the current pneumatic control systems, as the pulses are more succinct and faster and processed digitally. The signals are digitally processed when received at a very high rate of speed. This results in the patient's ability to make subtle adjustments to treadmill settings without awkward lag and medical personnel are able to tailor therapy sessions to individual patient needs.

It would be desirable to improve upon the known complicated and inefficient monitoring systems. Some current systems rely on a ring sensor to measure a shaft rotational speed to determine the treadmill belt speed. Conversely, it would be desirable to provide a speed display that is derived by metering the amount of current offered from the VFD to the motor (in Hz using increments 10 Hz for 10-60). The current is compared with a measured shaft speed of the drive roller at the treadmill belt (in revolutions per minute), wherein the speed can be deduced at the given RPM and the known belt diameter of 2.6", correlating current with speed. A software code is fine-tuned to adjust/calibrate the speed readout and allow to change with different gear settings, wherein different gear sets may be required for regulating the speed. It is a much more efficient and cost-effective system than metering the speed of the motor shaft at the treadmill and sending a pulse back to the control panel.

It is a purpose of this invention to fulfill these and other needs in the aquatic treadmill art in a manner more apparent to the skilled artisan once given the following disclosure.

The preferred system and method for monitoring and controlling a hydraulic treadmill by medical personnel, according to various embodiments of the present invention, offers the following advantages: ease of use; the ability to help patients recover from injuries by providing low-impact exercise options; the ability to provide safety features that ensure that therapists can effectively manage multiple patients, enhancing the overall therapy experience; the ability to store and retrieve individual training data allows for the customization of workout plans and monitoring of athletic performance; enhances user experience; comprehensive data management; improved durability and reliability; decreased water exposure; decrease UV radiation exposure; reduced exposure to harsh conditions; improved responsiveness to fine tuning of the speed control; and improved speed monitoring. In fact, in many of the preferred embodiments, these advantages are optimized to an extent that is considerably higher than heretofore achieved in prior, known systems and methods for monitoring and controlling an aquatic, hydraulic treadmill.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

In order to address the shortcomings of the prior, known systems and methods for monitoring and controlling an aquatic, hydraulic treadmill, it would be desirable to provide hydraulic power units that are specifically designed for integration with aquatic treadmills used in physical therapy and rehabilitation. The invention focuses on advanced monitoring, patient data access/storage and control systems to enhance the functionality, safety, and effectiveness of these treadmills in a pool environment. The key components of this invention include a programmable logic controller (PLC), programmable human-machine interfaces (HMIs) communicating with the PLC, a smaller HMI-1 at the power unit up on the pool deck for the physical therapist and a larger display to show speed, distance and time on treadmill for the patient in the pool, driven by a programmable headless HMI-2, located in the control pad, a variable frequency drive (VFD) and a 12-volt control pad at the treadmill in the pool for the patient, all of which work together to provide speed control, remote monitoring patient override capabilities, and comprehensive patient data management for the physical therapist.

Figure 1:
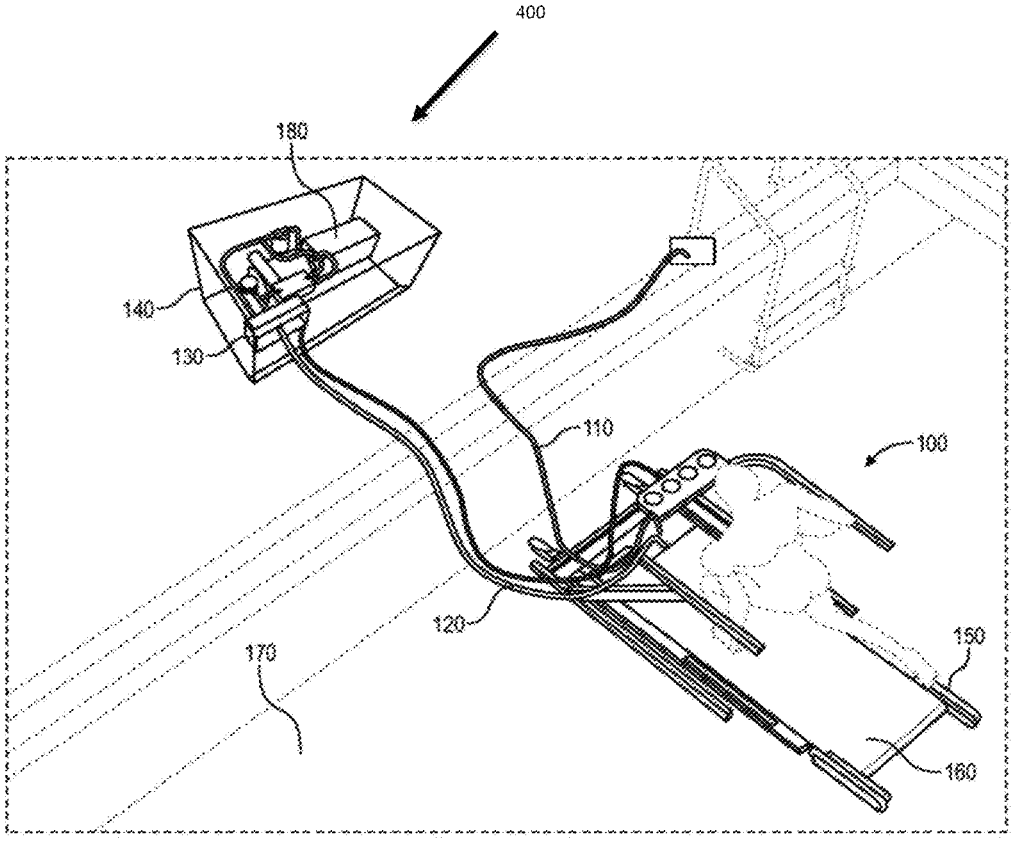
FIG. 1 illustrates a schematic view of an environment wherein the power unit on a pool deck with the control panel controlling the treadmill, in accordance with an embodiment of the present invention.

In accordance with an embodiment of the present invention, FIG. 1 illustrates a schematic view of the physical layout of the hydrotherapy treadmill in the pool. This figure shows the hydrotherapy treadmill 100 placed inside a swimming pool 170. The hydrotherapy treadmill 100 includes a treadmill main body including a treadmill belt 160, submerged in the swimming pool 170, mounted on a support rack having first and second longitudinal side rails 150. Further, the figure shows a base frame configured to mount the support rack and the treadmill belt 160. The first and second rollers (not shown in figure) are rotatably mounted on the support rack and positioned between and substantially perpendicular to the first and second longitudinal side rails. The treadmill belt 160 is an endless belt mounted around and extends between said first and second rollers for rotation therewith. Further, FIG. 1 shows a transmission system which comprises an electrically powered hydraulic pump 130, wherein the electrically powered hydraulic pump 130 rotates a hydraulic motor 180 of the treadmill belt 160 via a hydraulic input and output hose 120 connected to the treadmill main body at one end. The hydraulic pump 130 is powered by plugging, into a 120-volt power supply, a cord of a portable power unit mounted on a rolling cart 140.

Figure 2:
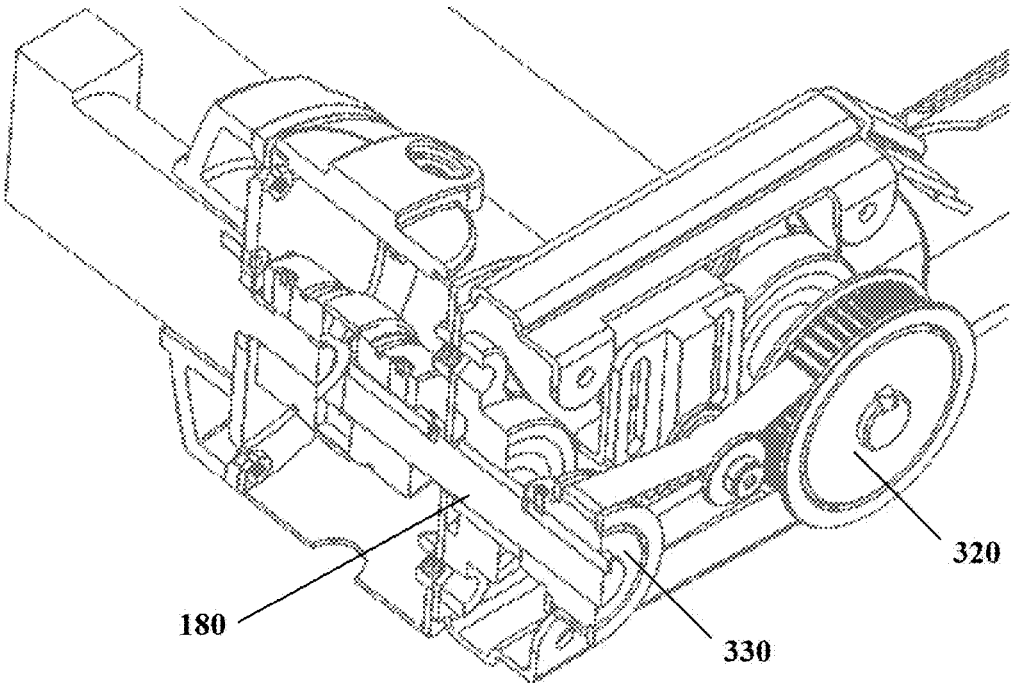
FIG. 2 illustrates a schematic internal view of the hydraulic motor, in accordance with an embodiment of the present invention.

In accordance with an embodiment of the present invention, FIG. 2 illustrates a schematic view of hydraulic motor 180. It shows a gearing going from a smaller diameter gear 330 at the hydraulic motor 180 to a larger diameter gear 320 at the drive roller, thereby allowing the treadmill to meet torque requirements at a slower speed, thus using less power and allowing the use of a 120-V power supply.

Figure 3:
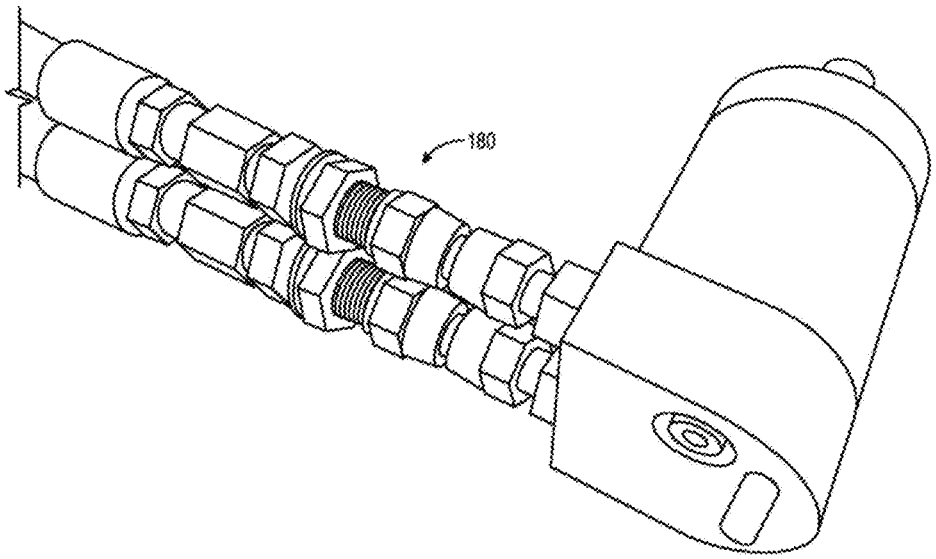
FIG. 3 illustrates a schematic back view of the hydraulic motor, in accordance with an embodiment of the present invention.

In accordance with an embodiment of the present invention, FIG. 3 illustrates a schematic view of an enclosure of a hydraulic motor 180. The hydraulic motor 180 provides the torque that is required to drive the treadmill rollers and move the surface of the treadmill belt 160 (FIG. 1) at a desired speed. The hydraulic motor 180 is powered by a hydraulic pump 130 (FIG. 1), which is typically housed up and out of the pool to avoid proximity to the water for safety purposes.

Figure 4:
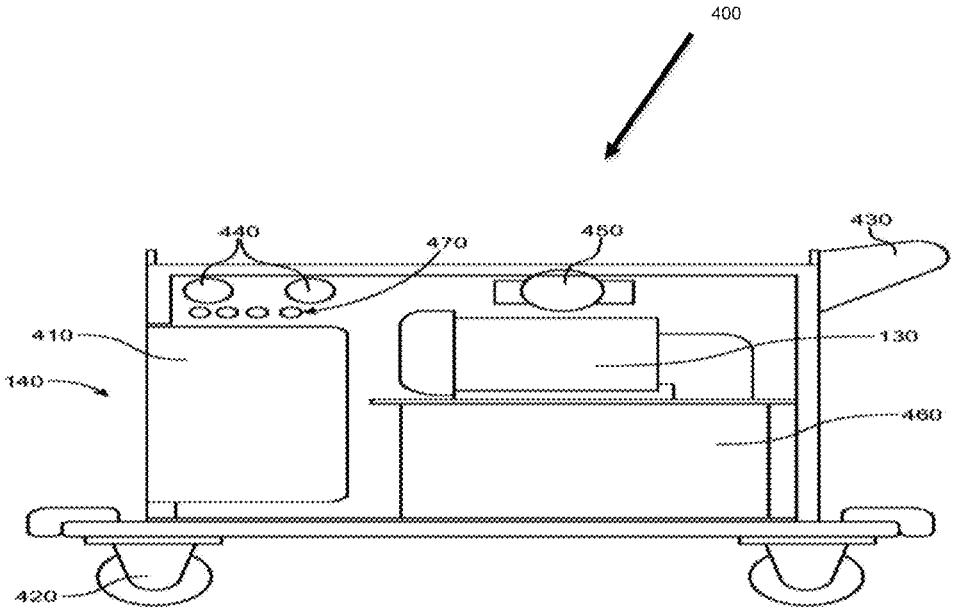
FIG. 4 illustrates a schematic view of a first embodiment of the portable power unit mounted on a rolling cart, in accordance with an embodiment of the present invention.

In accordance with an embodiment of the present invention, FIG. 4 illustrates a first embodiment of the portable power unit 400 mounted on a rolling cart 140, in accordance with an embodiment of the present invention. The portable power unit 400 corresponds to a portable power unit that is mounted on a rolling cart 140 and is used to power the hydraulic pump 130 (FIG. 1) that drives the hydraulic motor 180 of the treadmill, thereby allowing it to operate in the swimming pool 170. As a result, the portable power unit 400 on a rolling cart 140 provides a versatile and convenient power source for hydrotherapy treadmills, allowing them to be used in a variety of locations and settings. The rolling cart 140 further comprises a handle 430 and casters 420 which facilitates a user to easily move the rolling cart 140 from one place to another on the pool deck. Also, there is provided a hydraulic fluid reservoir 460 for supplying the operating fluid to the portable power unit 400 which powers the hydrotherapy treadmill 100. The electric controls 410 provide controls for operating the portable power unit 400. The inlet-outlet 440 provides connections for the input-output hoses 120 (FIG. 1) to the portable power unit 400.

The utility model has the advantages that the structure is simple, and the installation is convenient. Because the hydraulic motor 180 is used for transmission, the underwater mechanical operation part has no electrical contact, which is safe and reliable. In one embodiment, a variable frequency motor controls the speed of the hydraulic vane pump to adjust the running speed smoothly and evenly.

The hydraulic pump motor is loud; hence the present invention uses a sound insulated power pack unit (i.e., sound insulation 1105 in (FIG. 7A) to reduce noise.

Figure 5:
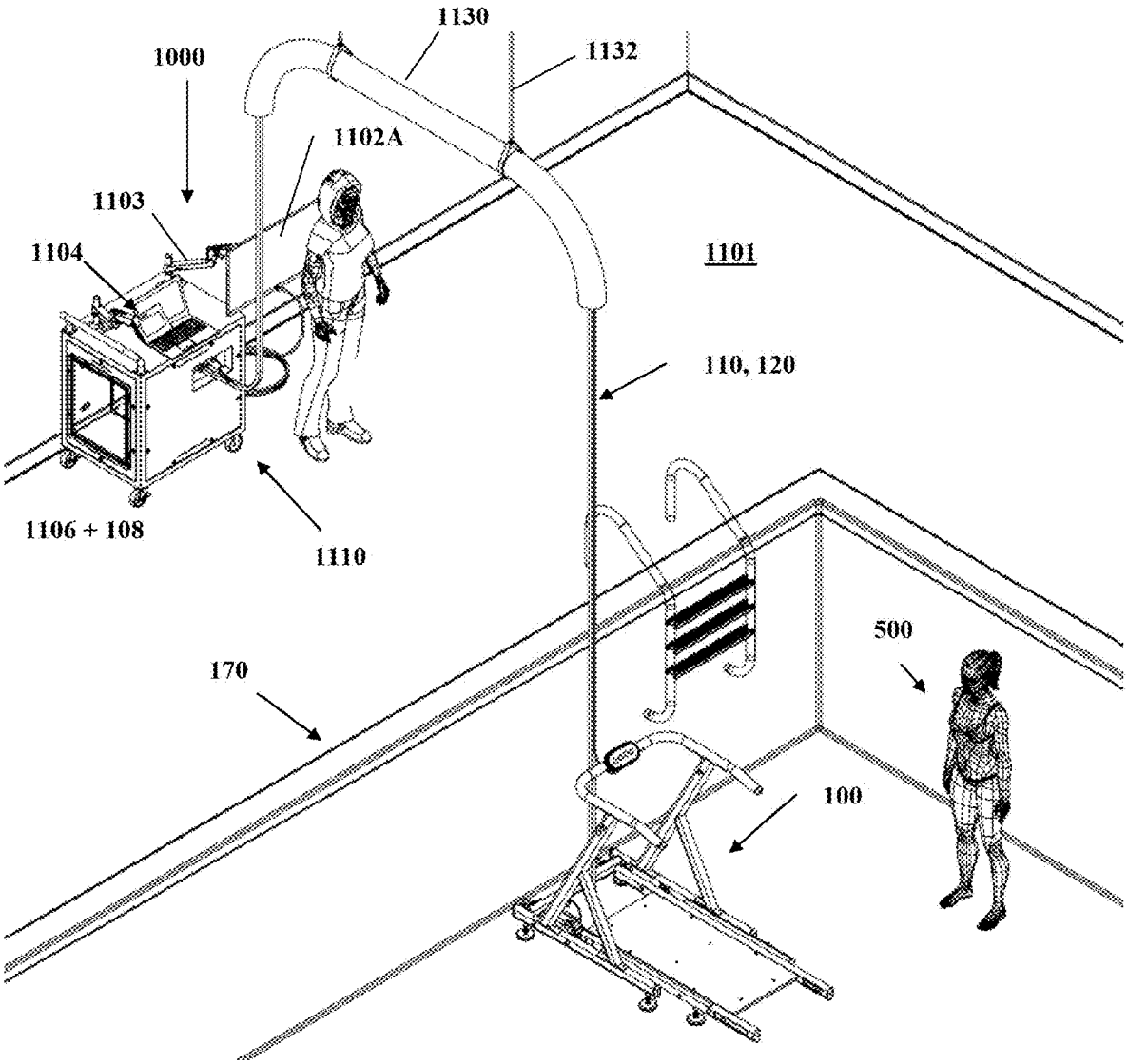
FIG. 5 is a schematic illustration of an environment wherein the power unit on a pool deck with the control panel controlling the treadmill, according to embodiments as disclosed herein.
Figure 7:
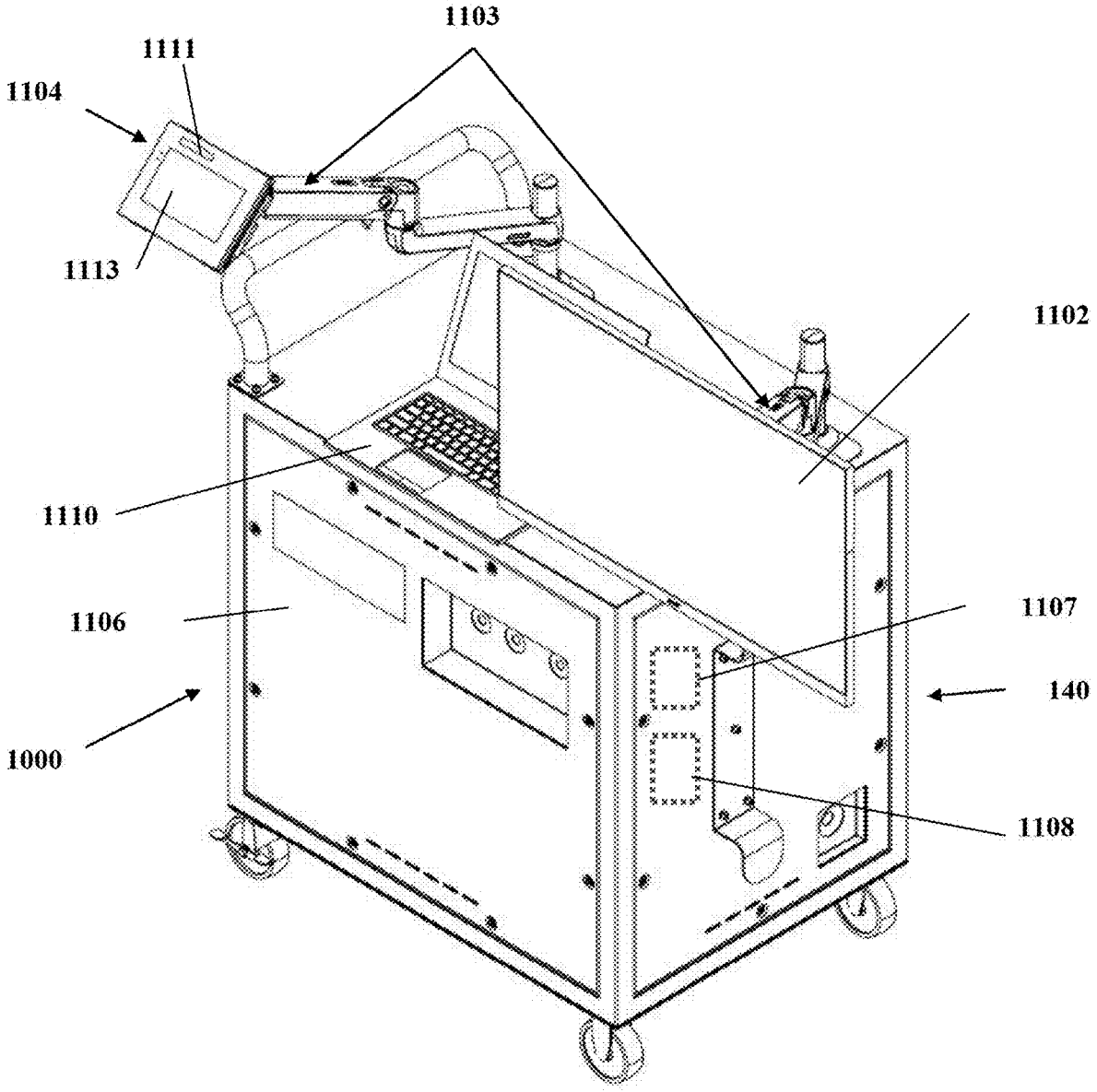
FIGS. 7 and 7A are schematic views of a second embodiment of a mobile cart having a patient display and a HMI, constructed according to an embodiment of the present invention.

Some of the non-limiting advantages of the present invention include:

1. Compatible with 120 V power supply. Hence, consumes less energy
2. Less site preparation expenses
3. Works with mobile power pack
4. Not restricted to a utility room where the hydraulic piping and electrical cable need to be routed in through the wall or floor FIG. 5 is an example diagram illustrating an environment wherein the power unit 1000 is located on a pool deck 1101 with the HMI 1104 controlling the treadmill 100 according to embodiments as disclosed herein. As illustrated in FIG. 1, treadmill 100 is placed inside the pool 170, with the patient 500 facing the power unit 1000 and a display 1102A mounted on a monitor arm 1103 with patient feedback to be shown on the display 1102A. As discussed above, the hydraulic input and output hose 120 is connected to the treadmill's main body at one end and a controls signal cable 110 is connected to a processor (PLC 1106 in FIG. 7) in the power unit 1000 that is configured to measure the speed of a user 500 running on the hydrotherapy treadmill 100. A programmable logic computer (PLC) 1106 is integrated within the power unit 1000. As discussed in greater detail later, the PLC 1106 automates the control processes by interpreting signals from the waterproof control pad 1216 (FIG. 10), HMI's 1104 (FIG. 7) and 1108 (FIG. 7) and a plug-in laptop 1110 (FIG. 7).

With respect to the hydraulic power and return hoses 120, these hoses 120 connect the hydraulic pump 130 (FIG. 1) on the pool deck to the treadmill motor 180 submerged in the pool 170. In one embodiment, these high-pressure hoses 120 deliver hydraulic fluid from the hydraulic pump 130 to the treadmill's motor 180 in order to drive the treadmill belt 160. Preferably, in one embodiment, the hoses 120 are equipped with 316 stainless steel fittings and protective nylon sleeves to ensure durability and safety under high-pressure conditions.

As shown in FIG. 5, patient 500 can clearly see the monitor 1102 mounted to the power unit 1000 and will be able to observe his/her speed, distance and time on treadmill feedback. Entertainment content can also be displayed to pass time while the patient 500 is on the treadmill 100.

Figure 6:
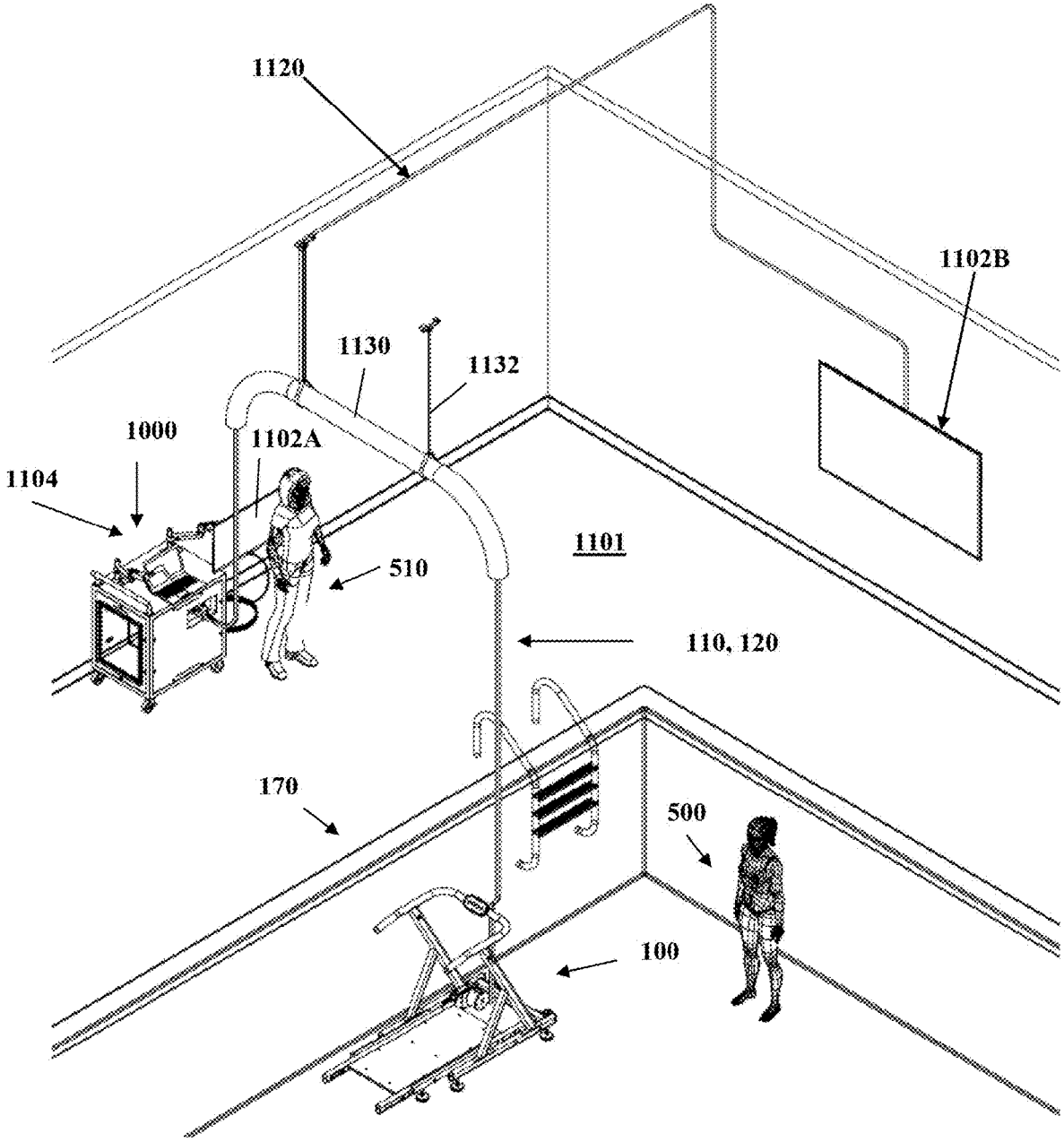
FIG. 6 is a schematic illustration of an environment wherein the power unit on a pool deck with the control panel controlling the treadmill, according to embodiments as disclosed herein.

With respect to FIG. 6, there is illustrated an example diagram of an environment wherein the power unit 1000 is located on a pool deck 1101 with the HMI 1104 controlling the treadmill 100. As illustrated in FIG. 6, treadmill 100 is placed inside the pool 170, parallel to the side of the pool and adjacent to the patient 500. A large wall mounted television display 1102B is used to provide to the patient 500 entertainment and patient feedback overlayed on the entertainment when called up by the patient 500 or medical personnel 510. Also, a communication cable 110 connects the wall mounted television display 1102B with the power unit 1000.

With respect to the larger display 1102B, this display 1102B provides more detailed information about the workout, such as speed, distance, time, calories burned, etc. It may also be used for entertainment purposes, such as displaying videos or other multimedia content while the user exercises. In particular, the patient 500 can watch the larger display 1102B for entertainment with feedback being information being sent from HMI-2 1108 (FIG. 7) at the power unit 1000 when called up by the patient 500 or medical personnel 510. It is to be understood that HMI-2 (headless HMI) is configured to process the information that is being displayed on the displays 1102A and 1102B.

As illustrated in FIGS. 5 and 6, the setup includes overhead support structures 1132, which may be used to prevent the hydraulic hose/signal cable tether 1130 that is providing power supply from the power unit 1000 to the treadmill 100 from becoming a trip hazard on the pool deck 1101.

As illustrated, the controls signal cable 110 is coupled to the hydraulic power and return hoses 120 forming the tether 1130 to allow the sending of communication signals to the PLC 1106 via an ethernet router (not shown).

Figure 7A:
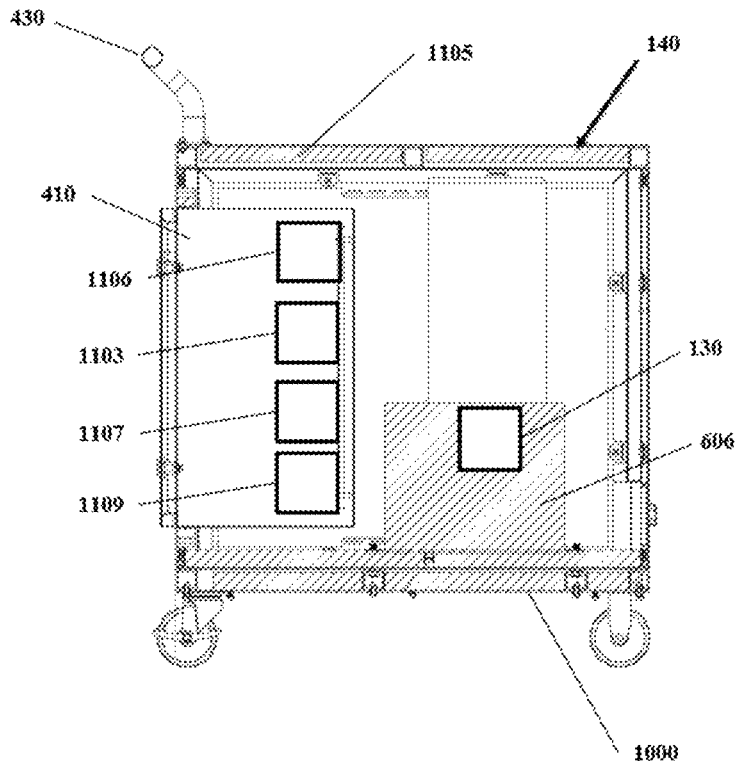
Figure 8:
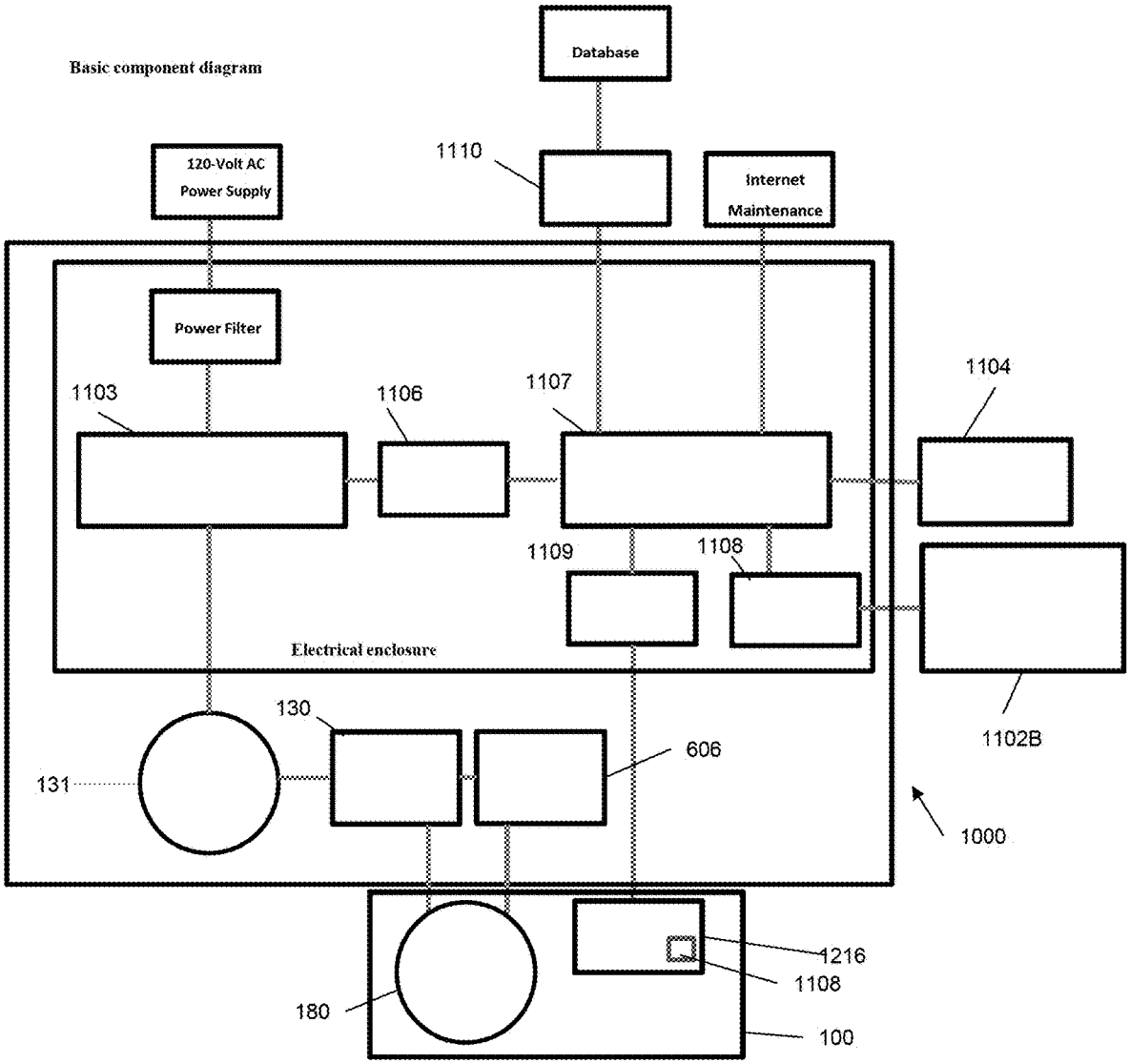
FIG. 8 is a schematic illustration of the various components of the power unit enclosure of the mobile cart for controlling the working of the treadmill, constructed according to an embodiment of the present invention.

Regarding FIGS. 7, 7A, and 8, patient display 1102A display, which is driven by the programmable, headless HMI-2 1108 (FIG. 7) located in the power unit 1000, is intended for patient use. It provides real-time feedback on various exercise metrics, including speed, distance, and time. Mounted with a monitor arm 1103 to the power unit 1000 display or a wall mounted TV display 1102B, the large display 1102B is typically about 12 meters from the treadmill (FIG. 6). It is to be understood that the display 1102B is also driven by the programmable, headless HMI-2 1108. Preferably, the display 1102B features a clear, user-friendly interface with large, easy-to-read text and graphics. This helps the patient 500 stay informed about their workout parameters without straining to see the screen. Also, the power unit 1000 includes a conventional hydraulic pump 130 and a hydraulic fluid reservoir 606 that are used to provide hydraulic fluid to the treadmill 100, as discussed earlier.

In one embodiment, the small programmable touchscreen human machine interface HMI-1 1104 includes a display 1113 is designed for the medical personnel 510 to control and monitor the treadmill's settings. It provides detailed control options and real-time data. The small HMI-1 display 1104 is mounted with a monitor arm 1103 to the power unit 1000 on the pool deck 1101, thereby creating a workstation for the medical personnel 510. In this manner, the HMI-1 display 1104 allows the medical personnel 510 to oversee the session and make necessary adjustments without entering the pool 170.

The human machine interface (HMI) 1104 is a touchscreen display that provides a visual interface for medical personnel 501 to easily interact with the treadmill 100 that is operatively connected to the power unit 1000. The HMI-1 1104 acts as the control hub for the treadmill system. The HMI-1 1104 allows a physical therapist 510 (FIGS. 5 and 6) to set and adjust maximum speeds, input patient-specific data, and monitor the treadmill's operation. In particular, the physical therapist 510 can set and adjust the speed limit that the patient 500 is not able to exceed if the patient 500 is using control pad 1216. The physical therapist 510 has the ability to stop the patient, but one of the critical aspects of the present invention is that the speed does not exceed the setting. This prevents the patient 500 from inadvertently setting the treadmill 100 to unsafe speeds. The 7" screen size makes it compact yet readable. This HMI-1 1104 is crucial for customizing the exercise experience to match individual rehabilitation needs. Also, in case of an emergency, therapist 1102 can immediately press an emergency stop switch 1111 to halt the treadmill 100. This switch 1111 is easily accessible and prominently illuminated for quick action. Finally, the HMI-1 1104 allows the therapist 510 to monitor the session, record data, and make real-time adjustments. Patient progress is recorded, and data can be transferred to standard hospital patient data software for further analysis and documentation.

The programmable logic computer (PLC) 1106 is integrated within the power unit 1000. In one embodiment, the PLC 1106 automates the control processes by interpreting signals from the control pad 1216 (FIG. 10), HMI's 1104 and 1108, and a plug-in laptop 1110. Also, the PLC 1106 manages the logic between the patient control pad 1216, HMI's 1106 and 1108, and laptop 1110, and PLC 1106 is pivotal in maintaining the overall functionality of the treadmill system.

The Variable Frequency Drive (VFD) 1103 is located as a part of the electrical controls within the power unit 1000. In one embodiment, the VFD 1103 controls the flow rate of hydraulic fluid to the treadmill 100 by varying the speed of the electronic inverter motor 131 that is driving the hydraulic pump 130, therefore controlling the speed of the hydraulic fluid to the treadmill hydraulic motor 180 (FIGS. 2 and 3), via the hydraulic hoses 120 (FIG. 1).

A unique aspect of the VFD 1103 is that the VFD 1103 converts an input currant of single-phase 120 volts to an output current of three-phase 220 volts, thereby providing the necessary power for the treadmill hydraulic motor 180 and enabling precise control over the treadmill's speed.

The power unit 1000, incorporating the hydraulic pump 130 and electrical controls, is mounted on a portable, mobile cart 140 for easy relocation on the pool deck. This design enhances flexibility and convenience for different usage scenarios. The system is designed to operate on a standard 120-volt input via a GFCI power outlet with a 20-amp breaker, with provisions for a 220-volt version to accommodate diverse customer needs.

Power unit 1000 also includes a virtual private network (VPN) router 1107 that assists with internet connectivity. The VPN router 1107 enables the treadmill system to connect to the internet securely. This connectivity might be used for firmware updates, maintenance, remote monitoring, and integrating with online fitness platforms. In one embodiment, the VPN router 1107 is powered by an external 24V DC power source (not shown) and has multiple ports for connecting various components.

The laptop 1110 may be used for programming the PLC 1106, monitoring the treadmill's performance, or managing user data. A database 1120 (FIG. 8) stores workout data, user profiles, and system logs, allowing for tracking performance and maintaining records. Error codes from the VFD, HMI's and other components can be accessed remotely to help debug issues in the field.

A converter 1109 adjusts the 12-V DC control pad signal power to 24V DC power for the voltage requirements of all the other components in the control panel. The converter 1109 ensures that each part of the system receives the correct voltage for optimal operation.

With respect to programmable headless HMI 1104B (FIG. 10), programmable, headless HMI 1104B drives the patient display screen 1102B and interfaces with the PLC 1106.

Another unique aspect of the present invention is the use of sound insulation 1105 (FIG. 7A). The sound insulation 1105 is provided on portable, mobile cart 140 in order to reduce the noise emanating from the power unit 1000 in a therapy environment.

In summary, FIGS. 7 and 7A represent a second embodiment of a complex control and power distribution system for a treadmill 100 located on a portable, mobile cart 140. The system is designed to be robust, with multiple layers of control and safety mechanisms. It incorporates a mix of power electronics (VFD, PLC), hydraulic systems, user interfaces (HMI), and internet connectivity to provide a sophisticated and user-friendly experience. Each component works together to ensure that the treadmill 100 operates smoothly, safely, and efficiently, with provisions for remote monitoring and control.

With respect to FIG. 8, FIG. 8 is a schematic illustration of the various components of the power unit 1000 of the mobile cart for controlling the working of the treadmill, as discussed above. FIG. 8 shows how all of the various components of the power unit 1000 are connected together and how they interact with each other.

Figure 9:
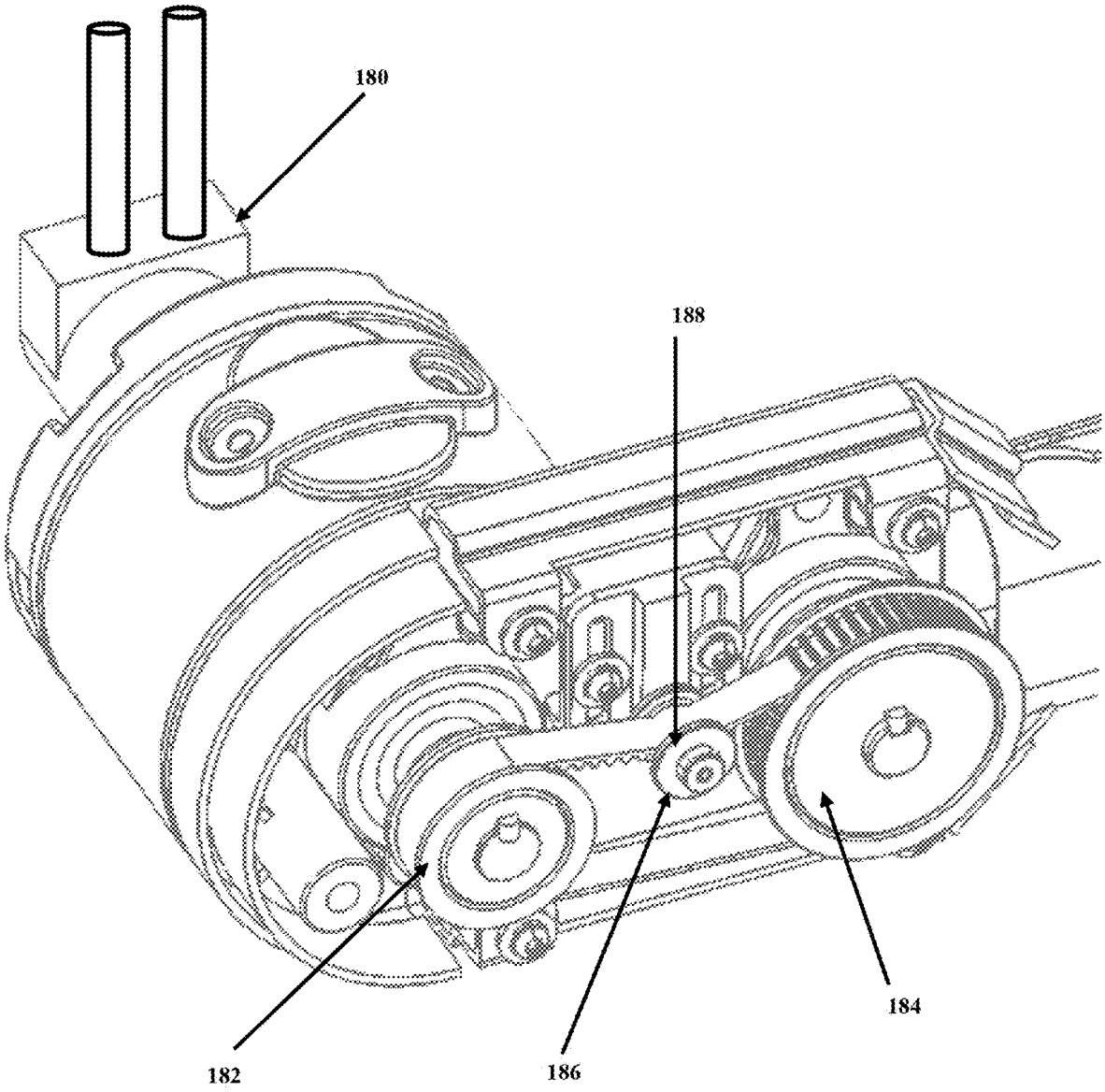
FIG. 9 is a schematic illustration of a hydraulic motor and gear set at the treadmill, according to embodiments as disclosed herein.

With respect to FIG. 9, there is illustrated a comprehensive view of a belt drive system, focusing on the hydraulic motor drive gear 182 of the hydraulic motor 180 on the left and belt drive roller gear 184 on the right. A smaller motor drive gear with larger roller drive gear will slow down the treadmill 100 and provide increased torque for therapy patients requiring slower speeds. Also, the belt drive system includes a conventional drive belt 186 and conventional belt tensioner roller 188 that is used to maintain a desired tension on the drive belt 186.

Figure 10:
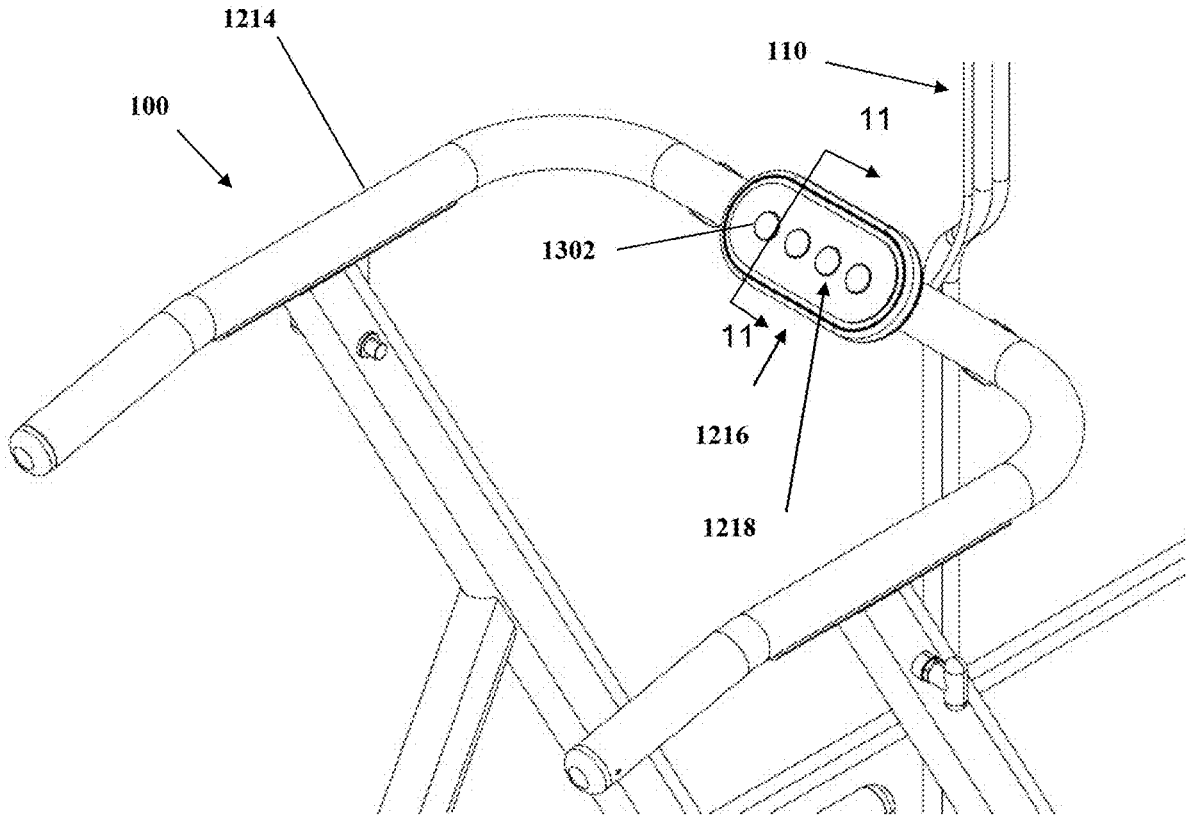
FIG. 10 is a schematic, isometric view of components of the treadmill used by the patient, along with control pads, constructed according to an embodiment of the present invention.

With respect to FIG. 10, in one embodiment, there is illustrated some of the components of the treadmill 100 used by the patient, along with a control pad 1216, a plurality of light emitting diode (LED) light rings 1218 for the corresponding buttons/switches 1302 configured on the control pad 1216 of the treadmill 100 to be located on the pool deck, according to embodiments as disclosed herein. It is to be understood that control pad 1216 is configured to be powered using 12-volts. As shown in FIG. 10, handrail 1214 forms the part of the treadmill 100 that users can grip for stability or to interact with the treadmill 100. Similarly constructed handrails are commonly found on fitness equipment like treadmills or other machinery where users need support while standing or moving.

Control pad 1216 is mounted on the handrail 1214 in order to make the control pad 1216 easily accessible to the user. In one embodiment, control pad 1216 will also include buttons/switches 1302 or touch-sensitive areas that allow the user to control the functions of the treadmill 100, such as starting, stopping, adjusting speed, or changing settings. Being mounted on the handrail 1214 ensures that the user can easily reach the controls while holding onto the rail for support.

LED light rings 1218 are associated with the buttons 1302 on the control pad 1216. These light rings 1218 serve as visual indicators to confirm user input. For example, when a button 1302 is pressed, the corresponding LED light ring 1218 that is located around that button 1302 might light up (i.e., illuminate an area around the button 1302 that is associated with that particular light ring 1218) to indicate that the command from the user has been received. This feature improves the user interface by providing immediate feedback, thereby ensuring the user knows their input was successful. The handrail 1214 offers support, while the control pad 1216 provides convenient access to control functions, thereby making it possible to operate the treadmill 100 without letting go of the handrail 1214. The LED light rings 1218 add an extra layer of user visual feedback.

A 12-volt controls signal cable 110 runs from the control pad 1216 on the treadmill 100 to the power unit 1000. In one embodiment, this low-voltage waterproof cable 110 transmits signals from the control pad's buttons/switches 1302 to the PLC 1106. A unique aspect of the controls signal cable 110 is that it ensures safe communication between the user interface and the control mechanisms, thereby minimizing electrical hazards in the wet pool environment. The hoses 120 combined with cables 110 form a tether between the power unit 1000 and treadmill 100.

With respect to FIGS. 5-9, there are illustrated the hydraulic power and control units of the treadmill 100. FIG. 8 provides a detailed visual representation of the components and configuration of the custom hydraulic power unit and electrical controls for a treadmill 100 used in a pool environment. Each part plays a crucial role in the overall functionality and safety of the system.

The treadmill 100 serves as the central exercise apparatus, enabling users to engage in walking or running activities while the treadmill 100 and the user are submerged in a pool 170 (FIG. 1). This setup leverages the resistance provided by water, which is beneficial for low-impact therapy and rehabilitation. The display unit 1102B (FIG. 6) mounted on the pool deck, often on a swing arm 1103 for adjustable viewing angles. This 24-inch computer monitor 1102B displays vital operational data, including speed, time, and distance. Its size and mounting ensure visibility from up to 8 meters away, catering to users who might have visual impairments or need to observe the display from a distance while exercising.

Figure 11:
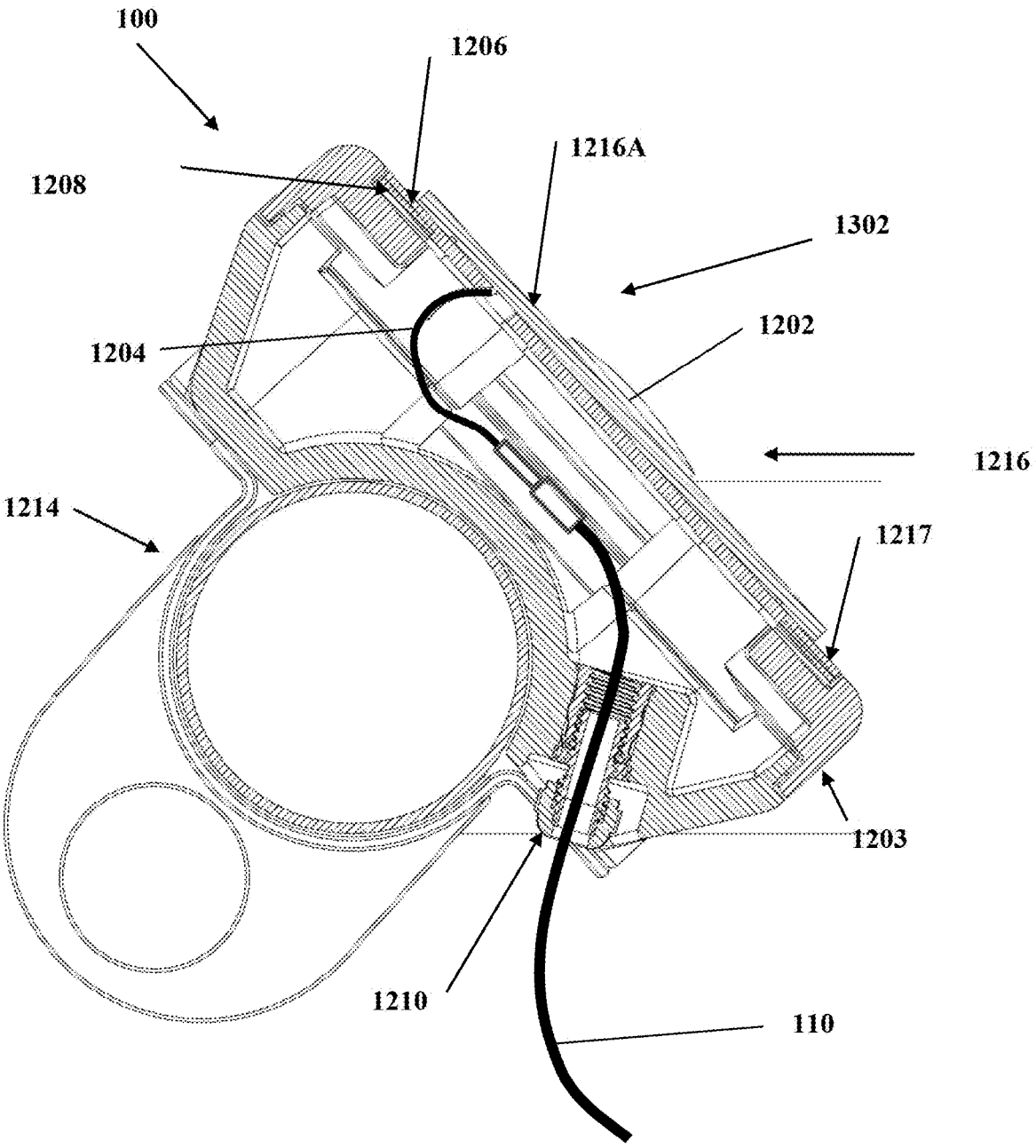
FIG. 11 is a cross-section view of the waterproof control panel with tactile membrane switches installed on the treadmill taken along lines 11-11 in FIG. 10, constructed according to an embodiment of the present invention.

With respect to FIGS. 10 and 11, there are illustrated a waterproof control pad 1216 with tactile membrane switches 1302 installed within a plastic housing 1203 (FIG. 12) on the treadmill 100. In particular, a waterproof gasket joint 1208 (FIG. 11) is illustrated. The silicone gasket 1208 creates a waterproof seal for the control pad 1216 where the upper and lower pad housings are joined together. This ensures that water, dust, and other contaminants do not enter the control pad 1216, thereby protecting the internal electronics of the control pad 1216 and maintaining the device's integrity.

Regarding adhesive tactile switch/controls pad 1216A, this controls pad 1216A contains the buttons 1302 or switches that allow users to operate the device. It is conventionally adhered to a support plate 1217 on the control pad 1216. A unique aspect of the present invention is the use of raised areas 1202 on the control pad 1216. In particular, raised areas 1202 on the control pad 1216 indicate the location of the buttons 1302. These embossed raised areas/bumps 1202 help users find and press the buttons 1302 without looking. In this manner, the tactile feedback from pressing on the raised area/bump 1202 provides a confirmation that a button 1302 is pressed or activated. Furthermore, the tactile feedback from the membrane buttons/switches 1302 make a popping sensation when pressed that ensures that users can feel the activation of the buttons 1302, which include functions such as start, stop, and speed adjustment.

As discussed earlier, the light rings 1218 around each tactile button/switch 1302 provide an additional feedback or confirmation that a button 1302 is pressed or activated.

With respect to cable seal 1210, cable seal 1210 assists in keeping the interior of the control pad 1216 waterproof. Furthermore, the cable seal 1210 ensures that the point where the cable 110 exits or enters the handrail 1214 remains watertight. This is crucial for maintaining the waterproof integrity of the device, thereby preventing moisture from entering through an entry point of the cable 110.

Regarding the waterproof joint 1206, the waterproof joint 1206 provides a sealed connection point where the ribbon cable 1204 interfaces with other components of the control pad 1216. In this manner, the waterproof joint 1206 ensures that water does not penetrate the control pad 1216, thereby protecting the electrical connections and maintaining the integrity of the control system.

With respect to FIGS. 10 and 11, there are illustrated a robust and user-friendly waterproof control panel 1216 designed for the aquatic treadmill system. The control panel 1216 integrates several waterproofing features, including silicone gaskets and specialized seals, to ensure reliable operation in wet conditions, as discussed above. The tactile membrane switches 1302 and embossed switch bump out 1202 (FIG. 11) provide an intuitive and responsive user interface, while the cable 110 and tether ensure secure and efficient signal transmission to the power unit. It is to be understood that the connection between ribbon cable 1204 and cable 110 does not have to be waterproof. This design ensures that the control pad 1216 remains functional, safe, and durable, even in the challenging environment of a pool deck.

Figure 12:
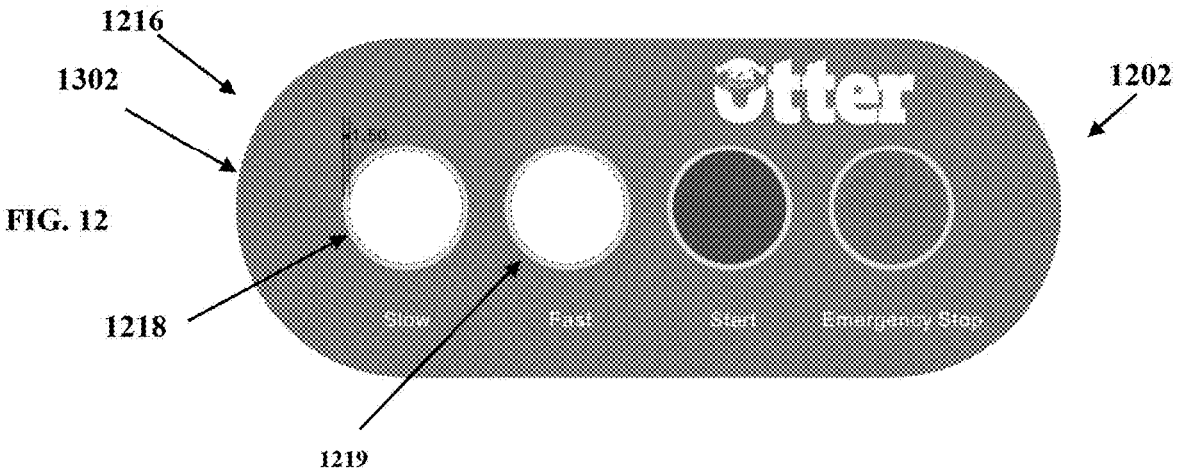
FIG. 12 is a schematic illustration of light emitting diode (LED) light rings for use with the control pad, constructed according to an embodiment of the present invention.
Figure 13:
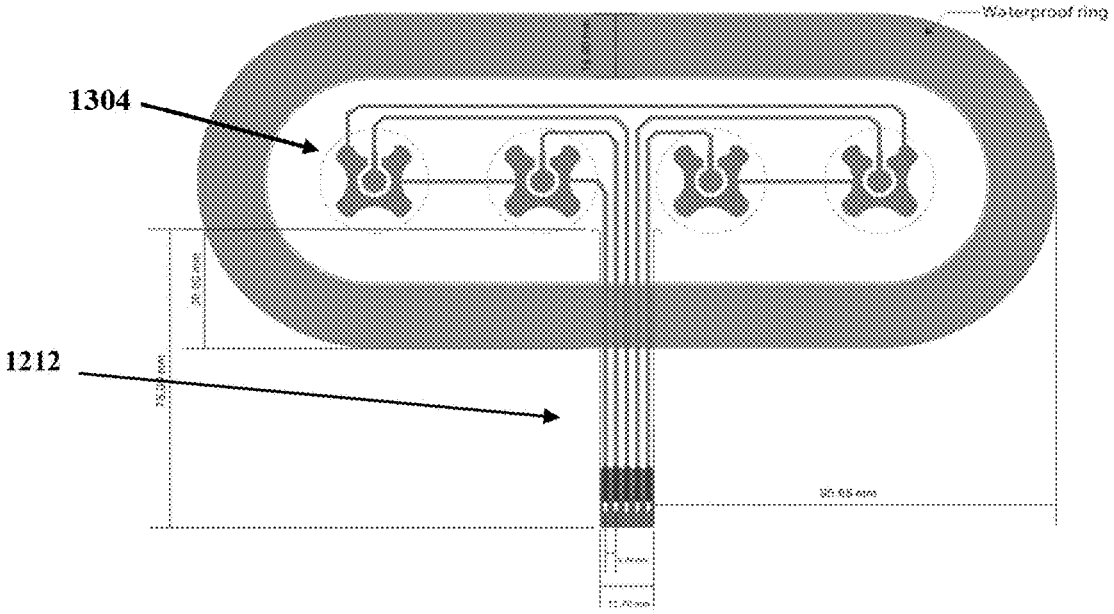
FIG. 13 is a schematic illustration of a robust and user-friendly waterproof control panel designed for the aquatic treadmill system, constructed according to an embodiment of the present invention.

FIG. 12 is an example diagram illustrating a light emitting diode (LED) light rings 1218 for the corresponding switches 1302 configured to the control pad 1216 of the treadmill to be located on the pool deck. As discussed above, LED light rings 1218 are illuminated when a button 1302 is pushed. It is to be understood that the LED light option is omitted in FIG. 13 on the button layout 1304. In particular, the additional wires in the circuit that would be required are not shown. Furthermore, as shown in FIG. 12, LED light rings 1302 are associated with four switches/buttons 1302 such as slow, fast, start, and emergency stop that are configured on the control pad 1216 of the treadmill. As discussed above, an outer layer 1219 of the LED light rings 1219 includes a waterproof ring.

Figures 14A, 14B:
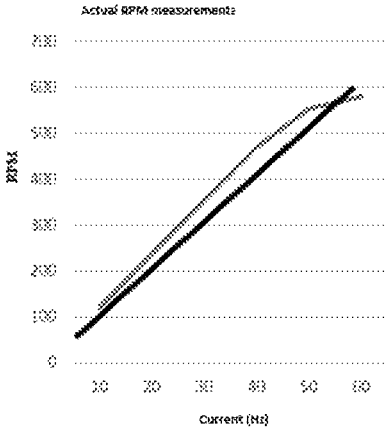
FIGS. 14A and 14B are graphical illustrations for use in comparing the current with the measured shaft speed, according to embodiments as disclosed herein.

With respect to FIGS. 14A and 14B, FIG. 14A is a graphical illustration of the comparison of current with the measured shaft speed, according to embodiments as disclosed herein. As illustrated in FIG. 14B, the current is compared with a measured shaft speed of the drive roller at the treadmill belt 160 (in revolutions per minute), wherein the speed can be deduced at the given RPM, correlating current with speed.

Therefore, as illustrated in the graph in FIG. 14A, the current is compared with the measured shaft speed by obtaining the RPM measurements. In a speed correlation system, a flat curve is used to simplify the software code, wherein the curve is made flat for simplicity. A ratio can be modified easily for various gear sets or calibration.

Operation of System for Monitoring and Controlling an Aquatic, Hydraulic Treadmill With respect to the operation of the system for monitoring and controlling an aquatic, hydraulic treadmill, attention is directed to FIGS. 5-14. Assume that a patient 500 has recently had a knee replacement. The orthopedic surgeon who performed the knee replacement surgery recommended that the patient 500 contact another medical personnel 510 such as a physical therapist to start physical therapy on the patient's knee that has been replaced.

Typically, the patient 500 contacts the physical therapist to set up a schedule for rehabilitating the patient's knee. The patient 500 and the physical therapist will meet to review the medical records of the patient 500 and discuss a recommended rehabilitation schedule for the patient 500. It is to be understood that one of the recommended methods of rehabilitation will include using hydrotherapy treadmill 100.

After the rehabilitation schedule has been set up, the patient 500 will go to the pool 170 (FIGS. 5 and 6) in order to begin the hydrotherapy exercises as set forth in the rehabilitation schedule. The physical therapist will roll the cart 140 to the pool deck 1101 and plug the power unit 1000 into a conventional outlet (not shown). As discussed above, the physical therapist will then interact with the HMI-1 1104 in order to set and adjust maximum speeds of the treadmill 100, input patient-specific data, and monitor the treadmill's operation. The patient 500 will then enter the pool 170 and step onto the treadmill 100. It is to be understood that there may be several patients 500 in the pool 170 at the same time with each patient 500 using a different treadmill 100 and the physical therapist is monitoring the progress of each of the patients 500.

A unique aspect of the present invention is that the rehabilitation schedule may include pre-selected speeds and other such conditions under which the patient 500 will be subjected to during a particular rehabilitation session. For example, the physical therapist may set an initial treadmill speed of 0.8 miles per hour for the patient 500. Also, the physical therapist may set an initial upper heart rate for the patient 500. The physical therapist may also set progressive changes in the treadmill speed and the patient's heart rate over a series of rehabilitation sessions in order to increase the strength and mobility of the patient's knee.

After the patient 500 steps onto the treadmill 100, the patient 100 can touch or otherwise interact with buttons 1302 (FIGS. 10 and 11) to start the movement of the treadmill 100. For example, the patient 500 can touch the START button (FIG. 12).

Once the start button is activated, the treadmill 100 will begin to operate and the patient 500 will walk on the treadmill 100 at a pre-set speed, as discussed earlier. While the patient 500 is exercising on the treadmill 100, the PLC 1106 (FIG. 7) is measuring the speed and other operating conditions (heart rate, time on treadmill, distance, etc.) of the patient 500 using the hydrotherapy treadmill 100. As discussed above, patient progress is recorded, and data can be transferred to standard hospital patient data software for further analysis and documentation. It is to be understood that this process will be conducted during each of the patient's therapy sessions.

The patient 500 will continue to attend the hydrotherapy sessions and the physical therapist will access prior data set up and monitor each session to make sure the strength and mobility of the patient's knee is improving. In particular, in one embodiment, the patient data, including treadmill speed, treadmill time, and treadmill distance during a plurality of patient therapy sessions is recorded in the database 1120. The database 1120 is then accessed to access the patient's plurality of therapy sessions. The patient's plurality of therapy sessions are reviewed. Finally, a determination (usually by a medical personnel 510 such as a physical therapist) based upon the review, whether to maintain, decrease or increase the patient's treadmill speed.

Now assume that after a number of therapy sessions, the patient 500 has independently decided that his/her knee is feeling very good and that the patient 500 wants to increase an operating condition of the treadmill 100 such as the speed of the treadmill 100. Normally, the physical therapist determines the maximum speed at which the treadmill 100 should be operating for a particular patient 500. As discussed above, the physical therapist then enters that speed information into the HMI-1 1104. However, in this instance, the patient 500 interacts with the "FAST" button 1302 (FIG. 12) in order to increase the speed of the treadmill 100. If the physical therapist 510 does not approve of this increase in speed, the physical therapist 510 can then interact with the emergency stop button 1111 (FIG. 7) to cause treadmill 100 to stop operating. The physical therapist can then discuss the change in speed with the patient 500 and determine if the patient 500 is allowed to increase the speed. The physical therapist 510 is setting a limit that the patient is not able to exceed with their separate speed control or "override" They have the ability to stop the patient, but the most critical aspect of this application is just that the speed does not exceed the setting.

Definitions and Other Embodiments

In another embodiment, the described methods and/or their equivalents may be implemented with computer executable instructions. Thus, in one embodiment, a non-transitory computer readable/storage medium is configured with stored computer executable instructions of an algorithm/executable application that when executed by a machine(s) cause the machine(s) (and/or associated components) to perform the method. Example machines include but are not limited to a processor, a computer, a server operating in a cloud computing system, a server configured in a Software as a Service (SaaS) architecture, a smart phone, and so on). In one embodiment, a computing device is implemented with one or more executable algorithms that are configured to perform any of the disclosed methods.

In one or more embodiments, the disclosed methods or their equivalents are performed by either: computer hardware configured to perform the method; or computer instructions embodied in a module stored in a non-transitory computer-readable medium where the instructions are configured as an executable algorithm configured to perform the method when executed by at least a processor of a computing device.

While for purposes of simplicity of explanation, the illustrated methodologies in the figures are shown and described as a series of blocks of an algorithm, it is to be appreciated that the methodologies are not limited by the order of the blocks. Some blocks can occur in different orders and/or concurrently with other blocks from that shown and described. Moreover, less than all the illustrated blocks may be used to implement an example methodology. Blocks may be combined or separated into multiple actions/components. Furthermore, additional and/or alternative methodologies can employ additional actions that are not illustrated in blocks. The methods described herein are limited to statutory subject matter under 35 U.S.C § 101.

The following includes definitions of selected terms employed herein. The definitions include various examples and/or forms of components that fall within the scope of a term and that may be used for implementation. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

A "data structure", as used herein, is an organization of data in a computing system that is stored in a memory, a storage device, or other computerized system. A data structure may be any one of, for example, a data field, a data file, a data array, a data record, a database, a data table, a graph, a tree, a linked list, and so on. A data structure may be formed from and contain many other data structures (e.g., a database includes many data records). Other examples of data structures are possible as well, in accordance with other embodiments.

"Computer-readable medium" or "computer storage medium", as used herein, refers to a non-transitory medium that stores instructions and/or data configured to perform one or more of the disclosed functions when executed. Data may function as instructions in some embodiments. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, an application specific integrated circuit (ASIC), a programmable logic device, a compact disk (CD), other optical medium, a random access memory (RAM), a read only memory (ROM), a memory chip or card, a memory stick, solid state storage device (SSD), flash drive, and other media from which a computer, a processor or other electronic device can function with. Each type of media, if selected for implementation in one embodiment, may include stored instructions of an algorithm configured to perform one or more of the disclosed and/or claimed functions. Computer-readable media described herein are limited to statutory subject matter under 35 U.S.C § 101.

"Logic", as used herein, represents a component that is implemented with computer or electrical hardware, a non-transitory medium with stored instructions of an executable application or program module, and/or combinations of these to perform any of the functions or actions as disclosed herein, and/or to cause a function or action from another logic, method, and/or system to be performed as disclosed herein. Equivalent logic may include firmware, a microprocessor programmed with an algorithm, a discrete logic (e.g., ASIC), at least one circuit, an analog circuit, a digital circuit, a programmed logic device, a memory device containing instructions of an algorithm, and so on, any of which may be configured to perform one or more of the disclosed functions. In one embodiment, logic may include one or more gates, combinations of gates, or other circuit components configured to perform one or more of the disclosed functions. Where multiple logics are described, it may be possible to incorporate the multiple logics into one logic. Similarly, where a single logic is described, it may be possible to distribute that single logic between multiple logics. In one embodiment, one or more of these logics are corresponding structure associated with performing the disclosed and/or claimed functions. Choice of which type of logic to implement may be based on desired system conditions or specifications. For example, if greater speed is a consideration, then hardware would be selected to implement functions. If a lower cost is a consideration, then stored instructions/executable application would be selected to implement the functions. Logic is limited to statutory subject matter under 35 U.S.C. § 101.

An "operable connection", or a connection by which entities are "operably connected", is one in which signals, physical communications, and/or logical communications may be sent and/or received. An operable connection may include a physical interface, an electrical interface, and/or a data interface. An operable connection may include differing combinations of interfaces and/or connections sufficient to allow operable control. For example, two entities can be operably connected to communicate signals to each other directly or through one or more intermediate entities (e.g., processor, operating system, logic, non-transitory computer-readable medium). Logical and/or physical communication channels can be used to create an operable connection.

"User", as used herein, includes but is not limited to one or more persons, computers or other devices, or combinations of these.

While the disclosed embodiments have been illustrated and described in considerable detail, it is not the intention to restrict or in any way limit the scope of the appended claims to such detail. It is, of course, not possible to describe every conceivable combination of components or methodologies for purposes of describing the various aspects of the subject matter. Therefore, the disclosure is not limited to the specific details or the illustrative examples shown and described. Thus, this disclosure is intended to embrace alterations, modifications, and variations that fall within the scope of the appended claims, which satisfy the statutory subject matter requirements of 35 U.S.C. § 101.

To the extent that the term "includes" or "including" is employed in the detailed description or the claims, it is intended to be inclusive in a manner similar to the term "comprising" as that term is interpreted when employed as a transitional word in a claim.

To the extent that the term "or" is used in the detailed description or claims (e.g., A or B) it is intended to mean "A or B or both". When the applicants intend to indicate "only A or B but not both" then the phrase "only A or B but not both" will be used. Thus, use of the term "or" herein is the inclusive, and not the exclusive use.

Therefore, provided herein is a new and improved system and method for monitoring and controlling an aquatic, hydraulic treadmill, which according to various embodiments of the present invention, offers the following advantages: ease of use; the ability to help patients recover from injuries by providing low-impact exercise options; the ability to provide safety features that ensure that therapists can effectively manage multiple patients, enhancing the overall therapy experience; the ability to store and retrieve individual training data allows for the customization of workout plans and monitoring of athletic performance; enhances user experience; comprehensive data management; improved durability and reliability; decreased water exposure; decrease UV radiation exposure; reduced exposure to harsh conditions; improved responsiveness to fine tuning of the speed control; and improved speed monitoring.

In fact, in many of the preferred embodiments, these advantages of ease of use, the ability to help patients recover from injuries by providing low-impact exercise options, the ability to provide safety features that ensure that therapists can effectively manage multiple patients, enhancing the overall therapy experience, the ability to store and retrieve individual training data allows for the customization of workout plans and monitoring of athletic performance, enhances user experience, comprehensive data management, improved durability and reliability, decreased water exposure, decrease UV radiation exposure, reduced exposure to harsh conditions, improved responsiveness to fine tuning of the speed control, and improved speed monitoring are optimized to an extent that is considerably higher than heretofore achieved in prior, known systems and methods for monitoring and controlling an aquatic, hydraulic treadmill.

What is claimed is:

1. A system for monitoring and controlling a hydrotherapy, hydraulic treadmill, comprising:

a hydrotherapy, hydraulic treadmill having a control pad operatively connected to the hydrotherapy, hydraulic treadmill, wherein the control pad is configured to operate using 12 volts; and a power unit having a programmable logic controller (PLC), wherein the power unit is connected to the hydrotherapy, hydraulic treadmill and located remotely from the hydrotherapy, hydraulic treadmill, and wherein the power unit further comprises;

a first programmable human-machine interface (HMI) operatively connected to the PLC, a first display which is controlled by a headless HMI, and which is operatively connected to the power unit, a second display, wherein the second display is configured to allow a medical personnel to set and adjust a maximum speed such that a patient is not able to exceed the maximum speed, and a variable frequency drive (VFD) operatively connected to the PLC.

2. The system for monitoring and controlling a hydrotherapy, hydraulic treadmill, according to claim 1, wherein the control pad further comprises:

a waterproof housing having an adhesive tactile switch pad located on an upper side of the waterproof housing;

a plurality of buttons located along a portion of the adhesive tactile switch pad;

a light ring located around each of the plurality of buttons; and a cable operatively connected at one end to the control pad and at the other end to the power unit.

3. The system for monitoring and controlling a hydrotherapy, hydraulic treadmill, according to claim 1, wherein the system for monitoring and controlling a hydrotherapy, hydraulic treadmill further comprises:

a third display operatively connected to the power unit, wherein the third display is configured to provide entertainment and patient feedback overlayed on the entertainment, and wherein the third display is controlled by the headless HMI.

4. The system for monitoring and controlling a hydrotherapy, hydraulic treadmill, according to claim 1, wherein the variable frequency drive is configured to convert a single phase 120-Volt input current to 3-phase 220V output current and control a flow rate of hydraulic fluid to the hydrotherapy, hydraulic treadmill.

5. The system for monitoring and controlling a hydrotherapy, hydraulic treadmill, according to claim 1, wherein the power unit further comprises:

a virtual private network (VPN) router operatively connected to the PLC.

6. The system for monitoring and controlling a hydrotherapy, hydraulic treadmill, according to claim 2, wherein the plurality of buttons further comprises:

a raised area located on each of the plurality of buttons, wherein the raised area is configured to assist the patient in finding and pressing each of the plurality of buttons and to provide tactile feedback that each of the of the plurality of buttons has been activated.

7. A method of constructing a hydrotherapy, hydraulic treadmill system, comprising:

providing a hydrotherapy, hydraulic treadmill having a control pad operatively connected to the hydrotherapy, hydraulic treadmill, wherein the control pad is configured to operate using 12 volts; and connecting a power unit to the hydrotherapy, hydraulic treadmill, wherein the power unit is located remotely from the hydrotherapy, hydraulic treadmill, wherein the power unit includes a programmable logic controller (PLC), and wherein the power unit further comprises;

attaching a first programmable human-machine interface (HMI) to the PLC, attaching a first display to the power unit, wherein the first display is controlled by a headless HMI, attaching a second display to the power unit, wherein the second display is configured to allow a medical personnel to set and adjust a maximum speed such that a patient is not able to exceed the maximum speed, and attaching a variable frequency drive (VFD) to the PLC.

8. The method, according to claim 7, wherein the control pad further comprises:

providing a waterproof housing having an adhesive tactile switch pad located on an upper side of the waterproof housing;

locating a plurality of buttons along a portion of the adhesive tactile switch pad;

attaching a light ring around each of the plurality of buttons; and attaching a cable at one end to the control pad and at the other end to the power unit.

9. The method, according to claim 7, wherein the method further comprises:

attaching a third display to the power unit, wherein the third display is configured to provide entertainment and patient feedback overlayed on the entertainment, and wherein the third display is controlled by the headless HMI.

10. The method, according to claim 7, wherein the variable frequency drive is configured to convert a single phase 120-Volt input current to 3-phase 220V output current and control a flow rate of hydraulic fluid to the hydrotherapy, hydraulic treadmill.

11. The method, according to claim 7, wherein the power unit further comprises:

attaching a virtual private network (VPN) router to the PLC.

12. The method, according to claim 8, wherein the plurality of buttons further comprises:

attaching a raised area on each of the plurality of buttons, wherein the raised area is configured to assist the patient in finding and pressing each of the plurality of buttons and to provide a tactile feedback that each of the of the plurality of buttons has been activated.

13. A method of monitoring and controlling a hydrotherapy, hydraulic treadmill, comprising:

providing a hydrotherapy, hydraulic treadmill having a control pad operatively connected to the hydrotherapy, hydraulic treadmill, wherein the control pad is configured to operate using 12 volts;

connecting a power unit to the hydrotherapy, hydraulic treadmill, wherein the power unit is located remotely from the hydrotherapy, hydraulic treadmill, wherein the power unit includes a programmable logic controller (PLC), and wherein the power unit further comprises;

attaching a first programmable human-machine interface (HMI) to the PLC, attaching a first display to the power unit, wherein the first display is controlled by a headless HMI, and wherein the first display is configured to provide real-time feedback to a patient on various exercise metrics, including speed, distance, and time of the patient, attaching a second display to the power unit, wherein the second display is configured to allow a medical personnel to set and adjust a maximum speed such that the patient is not able to exceed the maximum speed, and attaching a variable frequency drive (VFD) to the PLC;

interacting, by the medical personnel, with the second display to set and adjust a maximum speed of the hydrotherapy, hydraulic treadmill; and enabling the patient to engage in physical activities while on the hydrotherapy, hydraulic treadmill and allowing the patient to interact with the control pad in order to allow the patient to control functions of the hydrotherapy, hydraulic treadmill, wherein the power unit, the first programmable human-machine interface (HMI), the first display, the second display, and the variable frequency drive (VFD) are used to monitor and control the hydrotherapy, hydraulic treadmill while the patient is using the hydrotherapy, hydraulic treadmill.

14. The method, according to claim 13, wherein the control pad further comprises:

a waterproof housing having an adhesive tactile switch pad located on an upper side of the waterproof housing;

a plurality of buttons located along a portion of the adhesive tactile switch pad, wherein the plurality of buttons is configured to control the functions of the hydrotherapy, hydraulic treadmill;

a light ring that is located around each of the plurality of buttons, wherein the light ring is configured to illuminate an area around each of the plurality of buttons; and a cable that is operatively connected at one end to the plurality of buttons in the control pad and at the other end to the power unit.

15. The method, according to claim 13, wherein the method further comprises:

a third display that is operatively connected to the power unit, wherein the third display is configured to provide entertainment and patient feedback, wherein the third display is configured to provide entertainment and patient feedback overlayed on the entertainment, and wherein the third display is controlled by the headless HMI.

16. The method, according to claim 13, wherein the method further comprises;

recording, in a database, patient data, including treadmill speed, treadmill on time, and treadmill distance during a plurality of patient therapy sessions; and accessing the database to access the patient's plurality of therapy sessions;

reviewing the patient's plurality of therapy sessions; and determining, based upon the review, whether or not to maintain, decrease or increase the patient's treadmill speed.

17. The method, according to claim 13, wherein the power unit further comprises:

a virtual private network (VPN) router that is operatively connected to the PLC, wherein the VPN is configured to assist with internet connectivity.

* * * * *